United States Patent [19]

Schoolman

[11] Patent Number: 4,947,868

[45] Date of Patent: Aug. 14, 1990

[54] PROTECTIVE CUFF APPARATUS FOR SURGERY

[75] Inventor: Arnold Schoolman, Kansas City, Mo.

[73] Assignee: Schoolman Scientific Corporation, Kansas City, Mo.

[21] Appl. No.: 229,510

[22] Filed: Aug. 8, 1988

[51] Int. Cl.[5] ..... A61G 9/16

[52] U.S. Cl. ..... 128/847; 128/917; 128/863; 604/308

[58] Field of Search ..... 128/846, 847, 863, 856, 128/917; 604/308, 313, 292, 290, 315-16, 317, 289, 293; 2/DIG. 7

[56] References Cited

U.S. PATENT DOCUMENTS

| | | | |
|---|---|---|---|
| 2,305,289 | 12/1942 | Coburg | 128/847 X |
| 3,625,206 | 12/1971 | Charnley | 128/846 |
| 3,763,857 | 10/1973 | Schrading | 128/847 X |
| 4,525,166 | 6/1985 | Leclerc | 604/313 X |
| 4,533,352 | 8/1985 | Van Beek et al. | 604/317 |

FOREIGN PATENT DOCUMENTS

| | | | |
|---|---|---|---|
| 532917 | 2/1922 | France | 604/313 |

*Primary Examiner*—Robert A. Hafer
*Assistant Examiner*—Kevin G. Rooney
*Attorney, Agent, or Firm*—Litman, McMahon & Brown

[57] ABSTRACT

A disposable surgical apparatus for removing potentially harmful vapor and airborne particulate, especially AIDS virus, from an operating zone, including an environment occupied by a surgeon during an operation comprises a vacuum generating system that draws the potentially harmful vapor and airborne particulate through a suction manifold mounted on the surgeon's wrists and outside the protective apparel donned by surgeons during operations. The apparatus further includes a suction conduit routed beneath the surgeon's protective apparel connecting the suction manifold cuff to a high efficiency filter and vacuum pump. The protective cuff is designed so as not to appreciably impair the movement or vision of the surgeon.

15 Claims, 1 Drawing Sheet

Fig. 1.
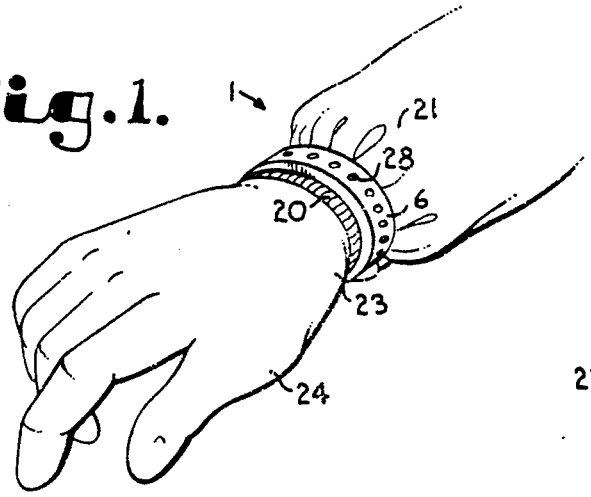
Fig. 2.
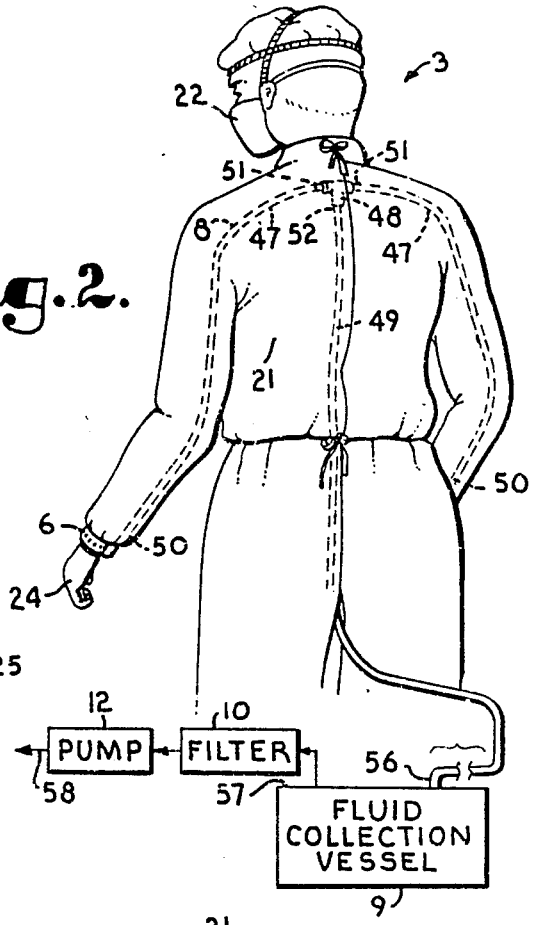
Fig. 3.
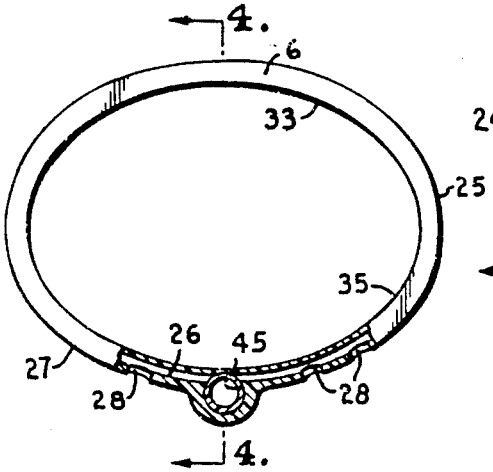
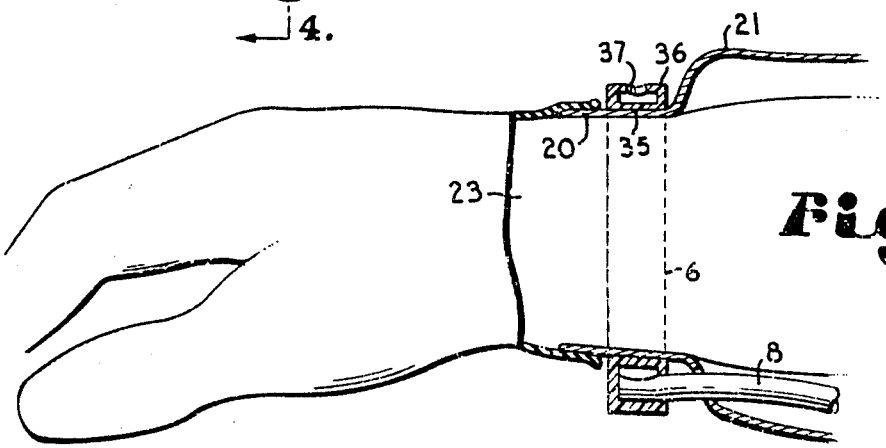
Fig. 4.

PROTECTIVE CUFF APPARATUS FOR SURGERY

BACKGROUND OF THE INVENTION

1. Field of the Invention.

The present invention relates to a surgical ventilating apparatus for protecting members of surgical teams from potentially harmful products in the form of vapor and airborne particulates which may issue from an operating zone.

2. Description of the Prior Art.

Since the advent of the discovery that bacterial and other microorganisms cause diseases and that such microorganisms are easily transmitted to a patient's incision from a carrier doctor, unclean instruments or even the air, hospital operating room procedures have incorporated methods to protect the patient by preventing contamination of the operating field and, ultimately, the patient. In particular, sources of patient contamination have included bacteria and other microorganisms shed or exhaled by members of the operating team and protective measures have included masks and other ventilating systems which operate to prevent contaminants shed or exhaled by members of the operating team from entering the surrounding atmosphere and, in particular, from entering the operating field. For example, U.S. Pat. No. 4,055,173 discloses a system for drawing air exhaled by a surgeon and the like away from the surgeon's face so as to limit contamination of the patient.

The Acquired Immunodeficiency Syndrome (AIDS) virus has created a substantial new problem for the surgeon. In particular, no satisfactory method or device has been provided by the prior art to help protect members of the surgical team from airborne contaminants originating in the operating field. These contaminants can and do include the AIDS virus. The current spreading epidemic of AIDS has imposed serious health risks on health care workers subjected to AIDS contaminated blood and body fluids. Such risks are particularly prominent for surgeons in all subspecialties and, also, for other operating room personnel where any drilling, reaming, cutting or the like must occur during an operation, as these processes create an aerosol of the patient's blood, tissue, bone or the like that becomes airborne and which can subsequently settle in a mucus membrane or open wound of a doctor or nurse thereby transmitting the fatal disease to them.

Accidental contamination with airborne aerosols of blood and body fluids of patients having other diseases such as hepatitis B also poses a risk. It has been found that some patients having these diseases have not had the disease for sufficient time to test positive for the disease and hence doctors, even if they test the patient before surgery, are not always warned of the danger.

Studies have identified the principle source of risk to be that associated with inadvertent inoculations through scalpel laceration, needle puncture, splashing and contact of contaminated serum or body fluids with an open wound, conjunctivae or mouth. Such studies are described in J. Bartlett, *Testing for HIV Infection: Recommendations for Surgeons*, Vol. 73, No. 3, American College of Surgeons Bulletin and G. Telford, et al., *A Protocol to Reduce the Risk of Contracting AIDS and Other Blood-Borne Diseases in the OR*, March, 1988, Surgical Rounds for Orthopedics.

Guidelines have been proposed to safeguard health care workers in such high risk areas. These consist mainly in recommendations for safe handling of sharp instruments and barrier precautions, including: gloves, face shield, impervious mask and gowns, and foot and leg wear. However, such precautions do not adequately address the risk associated with the effects of spraying and aerosolization of blood, body fluids and tissue during surgical procedures involving the use of many medical operating tools, especially power equipment such as high speed drills, saws and reamers of the type used by orthopedic surgeons and neurosurgeons. Such transmission modes have not been adequately addressed by the previously formulated guidelines.

The extent and effects of spraying and aerosolization of blood, body fluids and tissue during surgical procedures is dependent upon the size, shape and speed of the spray inducing devices and often the spray reaches well beyond the confines of the operating field.

It has been suggested that preoperative testing for the presence of risk-producing contaminants would, by indentifying such contaminants, allow surgeons to take special precautions. However, preoperative testing for patients inflicted with the human immunodeficiency virus (HIV), AIDS related complex (ARC) and hepatitis B has encountered legal constraints and is also problematic in operation. Legal constraints against preoperative testing have arisen because of the controversial nature of such testing. Preoperative testing is problematic because of the serum negative window noted above (i.e. early period in disease cycle when disease is not easily detectable) between exposure and sero positive test results. Preoperative testing is particularly problematic in emergency situations where low but significant percentages of trauma victims are sero positive and there is no time for preoperative testing.

Accordingly, it is highly desirable to confine the potential contaminant to the smallest area possible and, thus, minimize its dissemination and ultimate spread to members of the surgical team. This can be accomplished by creating a negative pressure zone in the field of operation which operates to remove the contaminants before they escape into the surrounding atmosphere. For this purpose, it is important that the low pressure zone be generated by a device which is close to the surgeon's hands, which are almost always at or around the site of the operation without impeding the dexterity or vision of the surgeon.

SUMMARY OF THE INVENTION

The present invention alleviates a substantial portion of the risk associated with conducting surgery on patients who are afflicted with AIDS and other extremely communicable and hazardous diseases. The invention is intended to be used by such a surgeon whether or not the surgeon knows the patient is infected, thereby reducing the risk especially associated with patients who have recently acquired the disease, but do not test positive or were not tested at all. The invention is also designed to not unduly encumber the surgeon or hamper vision or dexterity thereby making use of the invention attractive to the surgeon for all surgeries performed. An apparatus is provided for reducing the air pressure by producing a vacuum in the vicinity of the surgery thereby drawing most of the aerosols produced in the surgery (and consequently any AIDS virus or other microorganism) into the vacuum. The apparatus comprises a protective cuff including a hollow and expandable tube of endless configuration that is positioned, like a bracelet, over a surgeon's protective garment on each of the surgeons' wrists.

The cuff is hollow and has a plurality of apertures directed outwardly from an inner chamber. The inner chamber of the cuff is connected to a transfer conduit sized sufficiently small enough to be channeled between the surgeon's arm and the inside of the protective clothing donned by a surgeon during an operation. The conduit is attached through a high efficiency filter suitable to remove microorganisms to a vacuum pump system.

The vacuum pump induces a negative pressure in the transfer conduit, protective cuff and consequently in the area surrounding the cuff so as to draw air and airborne material and vapor from the region surrounding the surgeon's wrists into the cuff through the conduit and into the filter. The filter operates to remove the hazardous materials from the air. The filtered air is then drawn through a vacuum regulator into the vacuum pump where it is discharged into a vacuum pump discharge header. As the surgeon's hands are normally near the site of surgery, especially during an aerosol creating process, a substantial amount of the aerosols produced are drawn through the apparatus such that the microorganisms are captured by the filter. The entire apparatus, including the filter are disposed of and suitably destroyed along with the surgeon's outer clothing.

OBJECTS OF THE INVENTION

The principal objects of the present invention are: to provide an improved surgical apparatus for facilitating the removal of patient originated microorganisms from a surgical environment; to provide such an apparatus which is disposable; to provide such an apparatus which does not appreciably reduce the ease of access or field of vision by the surgeon to the operating field; to provide such an apparatus which draws a vacuum in the vicinity of the surgeon's hands so as to reduce the incidence of aerosols, produced by the surgeon acting on the patient, from escaping into the general surgical environment; and to provide such an apparatus which is relatively easy to manufacture, relatively inexpensive to produce and that is particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view showing a protective cuff portion of a protective apparatus, according to the present invention, mounted over a surgeon's protective clothing at the surgeon's wrist.

FIG. 2 is a rear perspective and partially schematic view of the apparatus on a reduced scale showing the positioning of the apparatus relative to the surgeon's clothing in phantom lines.

FIG. 3 is an enlarged side elevational view of the protective cuff, with portions broken away to show detail thereof.

FIG. 4 is an enlarged fragmentary cross-sectional view of the apparatus showing the protective cuff mounted over the surgeon's protective clothing on the surgeon's wrist, taken along line 4—4 of FIG. 3.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in detail, the reference numeral 1 generally designates a protective cuff apparatus or wrist vacuum apparatus according to the present invention. The protective cuff apparatus 1 generally includes a suction back member or cuff 6, a suction manifold means that in the present embodiment is illustrated as an elongate tube or a conduit 8, fluid collection means such as fluid collection vessel 9, filter means such as the illustrated filter 10 and a vacuum means such as the illustrated vacuum pump 12.

FIG. 1 illustrates the cuff 6 mounted over a sleeve 20 of conventional protective clothing 21 (surgical gown) worn by a surgeon 22. The cuff 6 is of suitable configuration for snugly fitting over the wrist 23 of the surgeon 22 (including glove and sleeve when such are worn). The cuff 6 comprises an elongate hollow band 25 circumferentially surrounding the wrist 23 and having an internal chamber 26 communicating with a radially outer surface 27 through a plurality of generally evenly spaced and equally sized vacuum apertures or openings 28 positioned at spaced locations along the surface 27.

The cuff 6 is formed of a suitable moisture resistant and substantially fluid impervious tubing-like material having sufficient resilience and flexibility to conform to the shape of the wrist 23 to which same is applied and is sufficiently expandable to fit over the surgeon's hand 24. Alternatively the cuff 6 can be broken and hinged therealong with a latch (not shown) so that the cuff 6 may be placed over the wrist 23 and secured in place by the surgeon 22.

In the illustrated embodiment the cuff 6 is fitted over the wrist 23 by forcing the surgeon's hand 24 through an aperture 33 defined by a radially inward facing surface 35 of the cuff 6.

Formed in the outwardly presented surface 27 of the cuff 6 (as it is mounted over the protective clothing 21 of the wrist 23) are the spaced openings 28. The spaced openings 28 are spaced and arranged so as to allow any air (or other fluid material surrounding the cuff 6) with hazardous contaminants therein to be drawn into the cuff 6. The contaminants may be aerosols formed during a medical or dental operation including microorganisms such as bacteria or viruses or may be hazardous chemicals or the like produced in an industrial manufacturing process.

Positioned on the cuff 6 is a conduit-receiving adapter 45 for connecting the tubular conduit 8 to the cuff 6 in such a manner as to allow fluid flow passing through said cuff openings 28 into the chamber 26 to flow into an interior lumen of the tubular conduit 8. In particular, the conduit-receiving adapter 45 allows air and hazardous contaminants therein to be drawn through the cuff 6 into the tubular conduit 8.

The tubular conduit 8 is constructed of any suitable tubular material, which is moisture resistant and substantially fluid impervious. The tubular conduit 8 comprises arm members 47, a "T" coupler 48 and a common header 49. Each of the pair of arm members 47 at a first end thereof 50 is attached to a respective conduit-receiving adapter 45 positioned on or near each of the surgeon's wrists 23. At a second end 51, the arm members 47 are sealably connected to the "T" coupler 48. The common header 49 at a first end 52 is sealably connected to the "T" coupler 48 and at a second end 53 to the collection vessel 9. The tubular conduit 8 allows air and hazardous contaminants to be transferred from the cuff 6 to the vessel 9.

The vessel 9 is preferably an open bottle to collect liquid or particles drawn into the apparatus 1 by the vacuum pump 12. The vessel 9 has an inlet 56 and an outlet 57 near an upper end thereof and a container bottle or body for holding liquid or particles passing therethrough.

The filter 10 is constructed of any suitable high efficiency filtering material which removes microorganisms and other particulate matter from air passing therethrough. The vacuum pump 12 is of any suitable type capable of creating and maintaining a preselected negative pressure at its inlet and discharging to a discharge header 58.

In use, after the protective clothing 21 and protective cuff apparatus 1 is donned by the surgeon in preparation for surgery, the vacuum pump 12 is connected to the common header 49 and operated to induce a negative pressure within the tubular conduit 8 and cuff 6 positioned over each wrist 23 of the surgeon 22 during an operation. While the surgeon 22 is conducting surgical procedures, air and hazardous contaminants, especially aerosols containing blood, tissue, body fluids, bone and the like, which become airborne in the operation field, are drawn into the spaced openings 28 in the expandable hollow tube 6, through the tubular conduit 8, the collection vessel 9 and into the filter 10, such that all or a substantial portion of the hazardous contaminants are removed from the air before the air exits the discharge header 58.

It is to be understood that while certain forms of the present invention have been illustrated and described herein, it is not to be limited to the specific forms or arrangement of parts described and shown.

What is claimed and desired to be secured by Letters Patent is as follows:

1. A cuff apparatus for use by a medical practitioner or the like during a procedure wherein contaminants may be released into the air; said apparatus for producing a zone of negative pressure near the hands of the practitioner to draw airborne contaminants in the proximity of the hands into said apparatus; said apparatus comprising:

(a) cuff means adapted to be secured in close proximity to the hands of the practitioner such that the hands of the practitioner are fully usable in a medical procedure and are exposed to ambient air; said cuff means including at least one aperture therein;

(b) suction pump means for inducing a negative pressure for drawing air therethrough; and (c) conduit means for flow connecting said apparatus of said cuff means to said suction pump means where air is drawn through said aperture to thereby draw airborne contaminants in the proximity of said hands of said practitioners into said apparatus.

2. The apparatus according to claim 1 including:

(a) filter means positioned between said cuff means and said suction pump means for removing a substantial portion of the contaminants from the air drawn through said suction pump means.

3. The apparatus according to claim 1 wherein:

(a) said cuff means is adapted to be located at the cuff of a protective gown.

4. The apparatus according to claim 3 wherein:

(a) a portion of said conduit means is incorporated in said gown and extends along at least one sleeve of said gown.

5. The apparatus according to claim 4 wherein:

(a) a pair of cuff means are provided at the cuffs of said gown and said pair of cuff means are flow connected to said suction pump means by said conduit means.

6. An apparatus for application to a wrist of a surgeon to maintain a negative atmospheric pressure zone in the proximity of a surgical incision in an operating field where a surgeon's hands are present and operating to draw air and contaminants into the apparatus; said apparatus comprising:

(a) cuff means comprising an elastic and flexible hollow tube of endless configuration with an outer surface and an inner surface; said inner surface adapted to snugly engage the wrist of the surgeon and sized to circumferentially surround the wrist; said outer surface having at least one opening extending radially outward therein; and a coupler;

(b) conduit means comprising a tubular conduit;

(c) filter means for substantially removing contaminants from air drawn through said apparatus; said filter in flow communication with said cuff means;

(d) suction pump means for inducing a negative pressure and flow connected to said conduit means to draw air and contaminants into said apparatus and through said filter means;

(e) whereby operation of said suction pump means produces a negative pressure in said conduit means and consequently said cuff means so as to remove contaminants from the environment surrounding the surgeon's wrist while in the operating field, through said filter means.

7. The apparatus according to claim 6 including:

(a) a pair of cuff means both flow connected to said conduit means; and in combination with (b) a protective gown having sleeves; said apparatus mounted at least partially within said gown such that each of said cuff means is positioned near a distal end of a respective one of said sleeves.

8. A wrist vacuum apparatus for use by a surgical practitioner to collect airborne contaminants in a vicinity of a hand of said practitioner, said apparatus comprising:

(a) vacuum pump means operative to draw air therethrough;

(b) a cuff structure for removable placement about the wrist of said practitioner during a surgical procedure; said cuff structure including vacuum aperture means located in a wall of said cuff structure; and (c) conduit means flow connecting said pump means to said aperture means through said cuff structure to thereby cause air to be drawn through said aperture means whereby airborne contaminants in a vicinity of said aperture means are collected and such that the hands of the practitioner are fully usable in a medical procedure and are exposed to ambient air.

9. An apparatus as set forth in claim 8 wherein:

(a) said cuff structure is tubular; and (b) a plurality of spaced apart apertures are formed through said cuff structure wall.

10. An apparatus as set forth in claim 9 wherein:

(a) said vacuum cuff is incorporated with a sleeve cuff of a sleeve of a surgical gown.

11. An apparatus as set forth in claim 10 wherein:

(a) said conduit means extends along said sleeve.

12. An apparatus as set forth in claim 8 and including:

(a) a pair of said aperture means adapted for attachment to both wrists of said practitioner; and (b) said conduit means is branched and fluidically connects with each of said aperture means.

13. An apparatus as set forth in claim 8 and including:

(a) collection vessel means fluidically communicating between said aperture means and said pump means.

14. An apparatus as set forth in claim 13 wherein said vessel means includes:

(a) air filter means operative to remove airborn contaminants from an airflow between said aperture means and said pump means.

15. A cuff apparatus for use by a medical practitioner or the like during a procedure wherein contaminants may be released into the air; said apparatus for producing a zone of negative pressure near the hands of the practitioner to draw airborne contaminants in the proximity of the hands into said apparatus; said apparatus comprising:

(a) cuff means adapted to be secured in close proximity to the hands of the practitioner; said cuff means including at least one aperture therein;

(b) a flexible and resilient hollow tube of endless configuration in the general shape of a torus with an outer surface and an interior surface spaced therefrom;

(c) said interior surface being a wrist engaging surface having an internal diameter sufficient to be adapted to snugly fit against a wrist of the practitioner;

(d) said outer surface having a plurality of spaced openings directed radially outwardly;

(e) a coupler to connect said cuff means to said conduit means;

(f) suction pump means for inducing a negative pressure for drawing air therethrough; and (g) conduit means for flow connecting said aperture of said cuff means to said suction pump means where air is drawn through said aperture to thereby draw airborne contaminants in the proximity of said hands of said practitioners into said apparatus.

* * * * *